US007677194B2

(12) United States Patent
Lanh

(10) Patent No.: US 7,677,194 B2
(45) Date of Patent: Mar. 16, 2010

(54) FINGER FLAG ASSEMBLY

(75) Inventor: Moeub Lanh, Tallahassee, FL (US)

(73) Assignee: Florida Agricultural and Mechanical University, Tallahassee ( * ) Notice: Subject to any disclaimer, the term of this patent is extended or adjusted under 35 U.S.C. 154(b) by 0 days.

(21) Appl. No.: 11/584,577

(22) Filed: Oct. 23, 2006

(65) Prior Publication Data

US 2008/0092797 A1 Apr. 24, 2008

(51) Int. Cl.
*G09F 17/00* (2006.01)

(52) U.S. Cl. ..... 116/173

(58) Field of Classification Search ..... 116/173
See application file for complete search history.

(56) References Cited

U.S. PATENT DOCUMENTS 1,670,176 A * 5/1928 Woolery ..... 116/35 R
2,646,796 A * 7/1953 Scholl ..... 602/60
3,217,690 A * 11/1965 Mihalisin ..... 116/173
3,308,479 A * 3/1967 Sesco, Jr. ..... 2/50
3,902,509 A * 9/1975 Tundermann et al. ..... 433/142
4,369,215 A * 1/1983 Offen et al. ..... 428/4
4,727,822 A * 3/1988 Wikkerink ..... 116/174
5,571,020 A * 11/1996 Troudet ..... 434/233
6,057,501 A * 5/2000 Hale ..... 84/470 R
6,155,836 A * 12/2000 Hancock ..... 434/188
6,409,059 B1 * 6/2002 Calvert ..... 223/101
6,951,464 B2 * 10/2005 Cubeta et al. ..... 434/159
7,012,169 B2 * 3/2006 McDevitt et al. ..... 602/41
7,059,265 B2 * 6/2006 Lehman ..... 116/28 R
2007/0169682 A1 * 7/2007 Boyd ..... 116/173
2008/0092798 A1 * 4/2008 Lanh ..... 116/173

FOREIGN PATENT DOCUMENTS

EP 1855265 A1 * 11/2007
JP 2001125519 A * 5/2001

OTHER PUBLICATIONS

Derwent-Acc-No. 2006-783854, Abstract & Drawings of DE 202006001365 U1, published Nov. 16, 2006, Title Hand-held flag consits of a length of textile with a hand-loop formed of e.g. a rubber band or a hook and loop fastener strap.*

* cited by examiner

*Primary Examiner*—R. A. Smith
*Assistant Examiner*—Tania C Courson
(74) *Attorney, Agent, or Firm*—Norris, Melton, PLLC

(57) ABSTRACT

A flag capable of being unfurled or crested in the wind without a flagpole comprising a flag with means for attaching the flag to a finger on a hand, the attaching means comprising panels that sandwich an end section of the flag, the attaching means further comprising a tubular member integrally attached to the panels, and wherein the tubular member has an inside diameter in an unstretched mode less than the outside diameter of a finger.

10 Claims, 3 Drawing Sheets

FINGER FLAG ASSEMBLY

BACKGROUND OF THE INVENTION

I. Field of the Invention

The present invention relates generally to a flag assembly, and more particularly, to a pole free flag suited for attaching to the finger as a banner, pennant, or anthem.

II. Description of the Related Art

It is known that flags are a potent symbol of pride, whether it be for a country, state, city, a professional, collegiate or high school sports team, or for events such as a soccer championships or the Olympics.

U.S. Pat. No. 4,018,182 disclose a golf flag assembly that provides a pair of facing panel members adapted to receive one edge of a golf flag therebetween so that when the panel members are secured together, the golf flag is securely entrapped and sandwiched between the panel members.

An ornamental flag having a silhouette cut-out and having an assembly for suspending the flag from a flag pole in a manner that prevents the flag from becoming tangled or wrapped around the flag pole is disclosed in U.S. Pat. No. 5,533,464.

There is a need for enthusiasts wishing to exhibit symbols of pride, either nationally or for prominent events in support of professional teams, college or high school teams and for occasions such as major tennis tournaments, the Olympics and World Cup soccer contests, to be able to do so without the burden of having to hold the flag banner by a pole that is attached to the flag in some manner.

SUMMARY OF THE INVENTION

One object of the present invention is to provide a flag that overcomes the disadvantages of previously known flags utilized as a symbol of pride and support for sporting and other events.

Another object of the present invention is to provide a flag that overcomes the disadvantages of previously known flags utilized as a symbol of pride and support for sporting and other events, that eliminates the need of a flag pole to hold the flag banner in an upright position so that the flag might crest in the wind.

A further object of the present invention is to provide a flag that overcomes the disadvantages of previously known flags utilized as a symbol of pride and support for sporting and other events, that can be inconspicuously and conveniently carried in a wallet, bill fold, or a pocket prior to use, without having a pole from the flag protruding or projecting in a cumbersome manner.

The foregoing and other objects of the invention will become more apparent by reference to the brief description of the drawings and detailed description of the preferred embodiment of the invention.

DETAIL DESCRIPTION OF PREFERRED EMBODIMENT OF THE INVENTION

In general, the invention encompasses a flag capable of being unfurled or crested in the wind without a flagpole comprising a flag with means for attaching the flag to a finger on a hand, the attaching means comprising panels that sandwich an end section of the flag, the attaching means further comprising a tubular member integrally attached to the panels, and wherein the tubular member has an inside diameter in an unstretched mode less than the outside diameter of a finger.

The attaching means is a resilient material, and may be cloth and the tubular material is elastic.

The method of unfurling or cresting a flag in the wind without the use of a flag pole, comprising placing a tubular member of a flag on the finger of a hand, the flag comprising means for attaching the flag to a finger on a hand, the attaching means comprising panels that sandwich an end section of the flag, the attaching means further comprising a tubular member integrally attached to the panels, and wherein the tubular member has an inside diameter in a unstretched mode less than the outside diameter of a finger.

Figure 1:
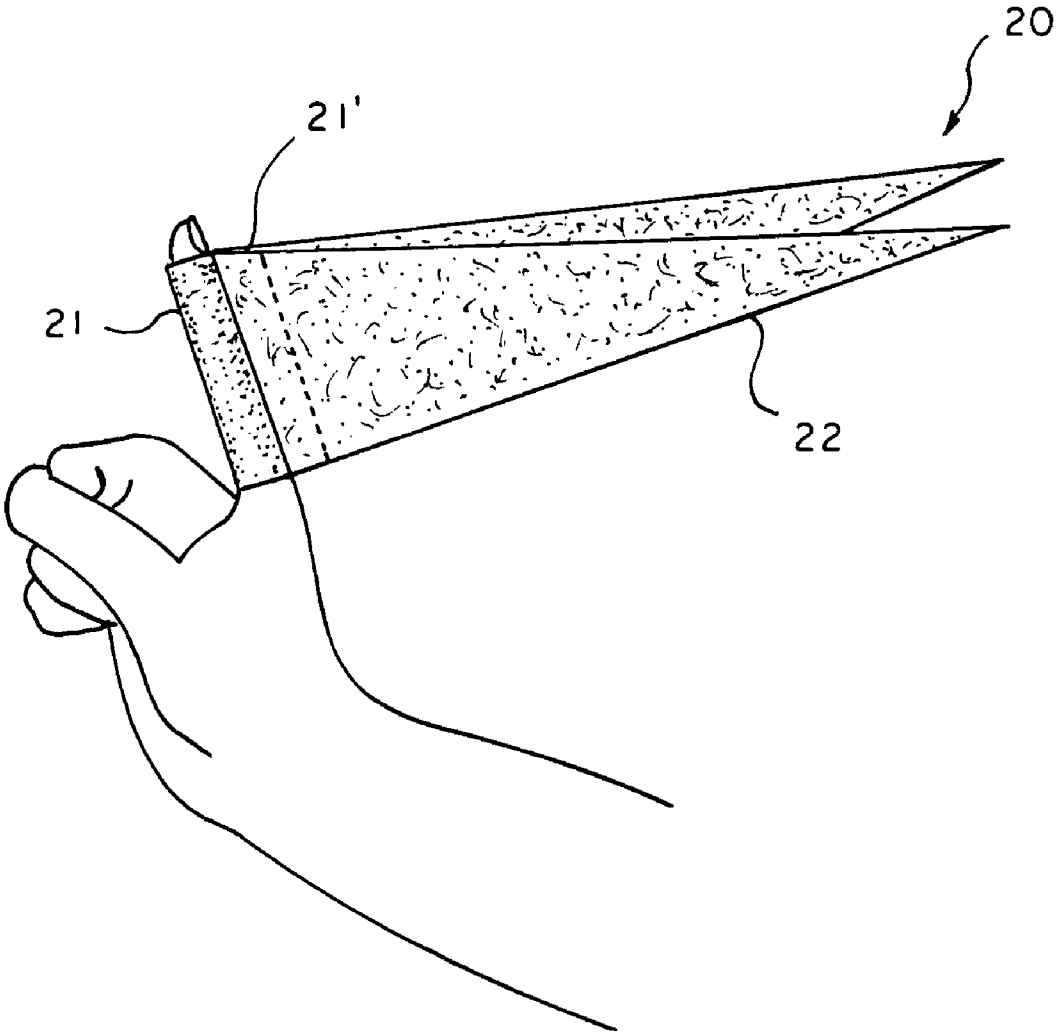
FIG. 1 is a perspective view of the flag assembled with a finger to enable it to crest in the wind.

Reference is now made to FIG. 1 of the finger flag assembly 20 positioned over an index finger to enable it to unfurl upon waving or wind gust. The flag assembly 20 will have emblazoned thereon an indicia (not shown) that is suitable for the particular event for which support or enthusiasm is shown. The Flag assembly may be constructed of any flexible material, but most preferably, cloth. However, the attachment means 21 and 21' is formed of an elastic material secured to the flag 22 by any conventional means, such as heat sealing, stitching or Velcro fastening.

Preferably, attachment means 21 is in a tubular shape, wherein the tubular member is open at both ends to accommodate positioning the flag 20 over any finger of the hand. The tubular member attachment means 21 and the panels 21' are an integral piece stitched or other wise held fast by conventional means to the flag 20.

The elastic tubular attachment means 21 is constructed so that its inside diameter is smaller than the outside diameter of any finger over which the flag is positioned, thereby assuring good grasp of the tubular member to the finger.

Figure 2:
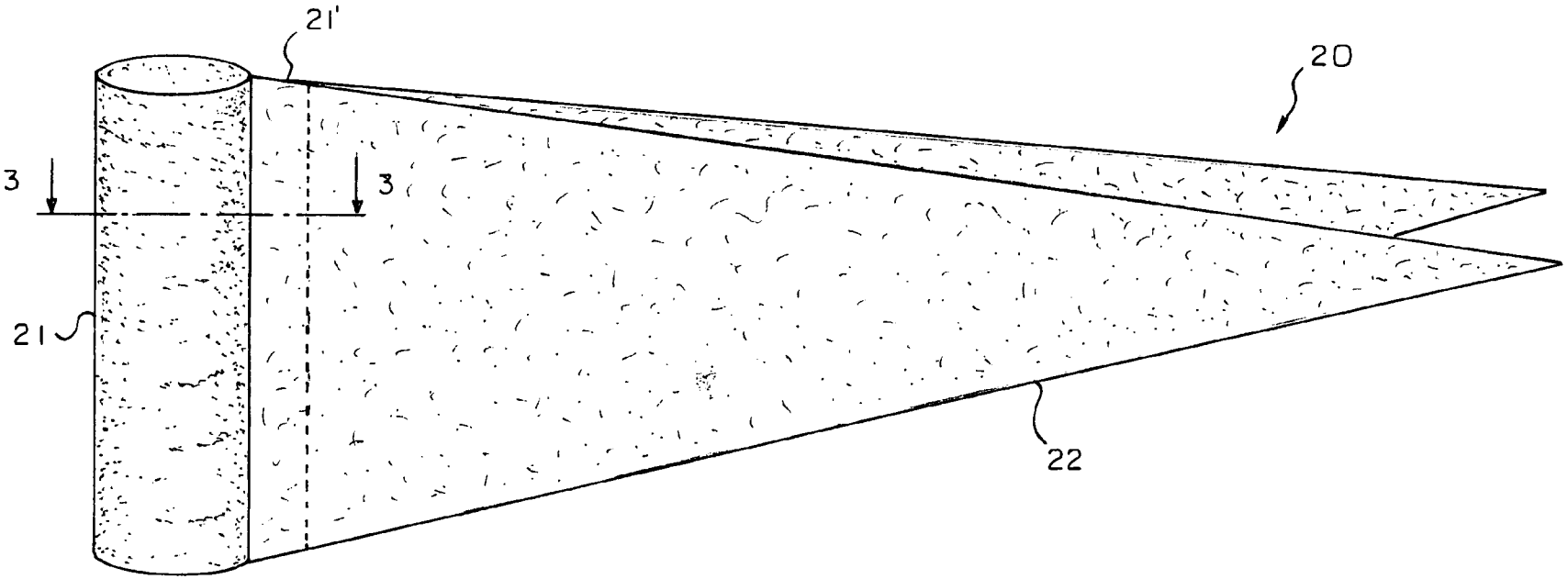
FIG. 2 is a view in perspective of the flag of the invention when not in assembly with a finger on a hand.

FIG. 2 is a view in perspective of the flag of the invention when not in assembly with a finger on a hand.

Figure 3:
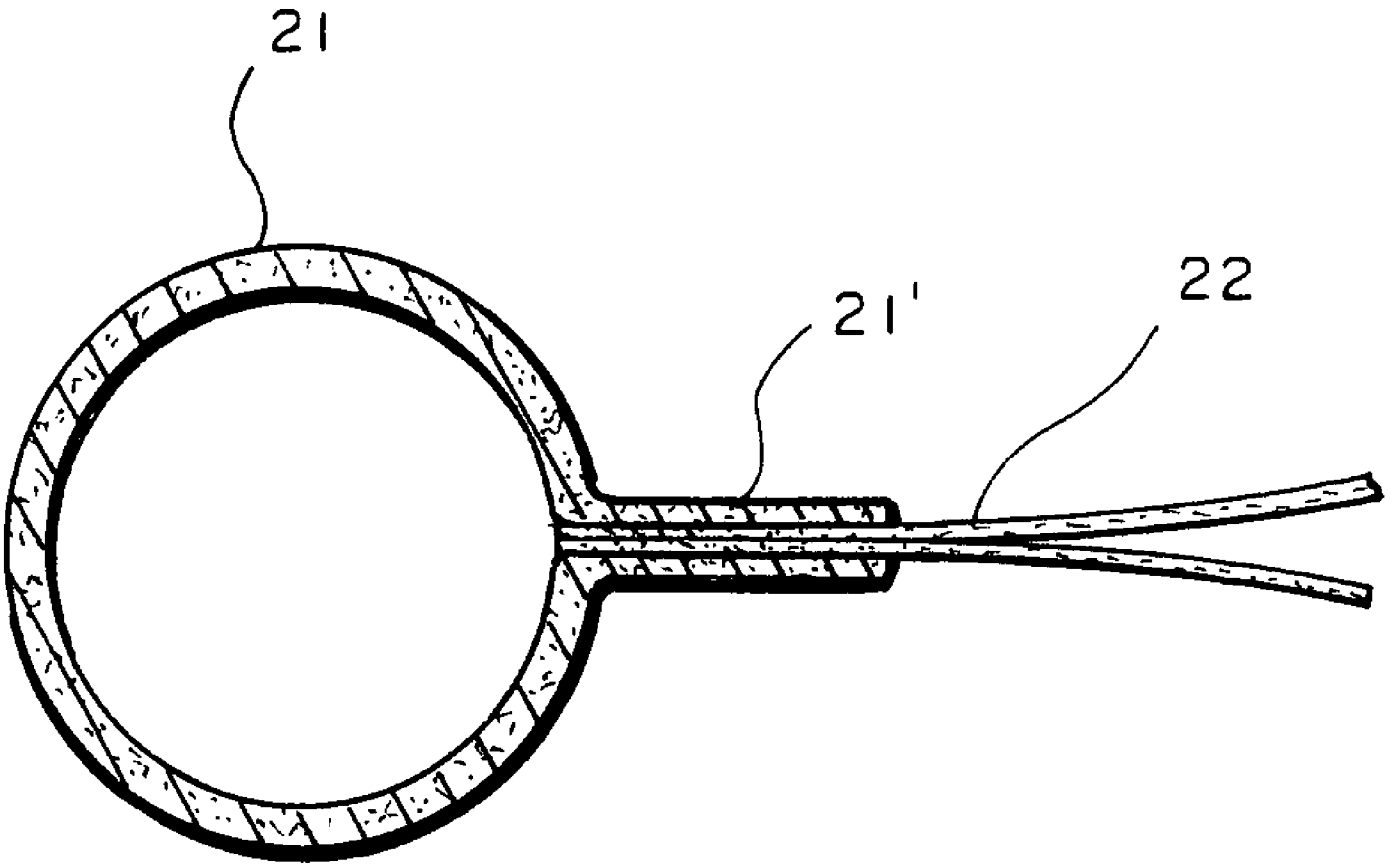
FIG. 3 is a fragmentary cross-section view along line 2-2 of FIG. 1.

FIG. 3 is a fragmentary cross-section view along line 2-2 of FIG. 1.

When not in use on a finger in support of an event, the flag may be folded so that it fits into a wallet, bill fold, pocketbook or even one's pocket.

While the invention has been described by reference to preferred embodiments, it will be apparent to those skilled in the art that modifications thereto can be made without departing from the spirit of the invention as defined by the scope of the claims hereafter appended.

I claim:

1. A flag capable of being unfurled or crested in the wind without a flagpole comprising means for attaching said flag directly adjacent to a finger on a hand, said attaching means comprising panels that sandwich an end section of said flag, said attaching means further comprising a tubular member integrally attached to said panels, and wherein said tubular member has an inside diameter in an unstretched mode less than the outside diameter of a finger.

2. The flag of claim 1 wherein said attaching means is a resilient material.

3. The flag of claim 2 wherein said resilient material is a cloth.

4. The flag of claim 3 wherein said tubular member is elastic.

5. In combination, an assembly of a finger on a hand, wherein said finger is inserted in a tubular member of a flag, wherein said flag comprises means for attaching said flag directly adjacent to a finger on a hand, said attaching means comprising panels that sandwich an end section of said flag, said attaching means further comprising a tubular member integrally attached to said panels, and wherein said tubular member has an inside diameter in a unstretched mode less than the outside diameter of a finger.

6. The combination of claim 5 wherein said attaching means is a resilient material.

7. The combination of claim 6 wherein the resilient material is cloth.

8. The combination of claim 7 wherein said tubular material is elastic.

9. A method of unfurling or cresting a flag in the wind without the use of a flag pole, comprising placing a tubular member of a flag on the finger of a hand, said flag comprising means for attaching said flag directly adjacent to a finger on a hand, said attaching means comprising panels that sandwich an end section of said flag, said attaching means further comprising a tubular member integrally attached to said panels, and wherein said tubular member has an inside diameter in a unstretched mode less than the outside diameter of a finger.

10. The method of claim 9 wherein the hand is waved back and forth.

* * * * *